US008530792B2

(12) United States Patent
Dyrdek

(10) Patent No.: US 8,530,792 B2
(45) Date of Patent: Sep. 10, 2013

(54) HEATED SIDE WINDOW GLASS

(75) Inventor: Robert Dyrdek, Elizabethtown, KY (US)

(73) Assignee: AGC Automotive Americas Co., Bellefontaine, OH (US)

( * ) Notice: Subject to any disclaimer, the term of this patent is extended or adjusted under 35 U.S.C. 154(b) by 1375 days.

(21) Appl. No.: 11/130,805

(22) Filed: May 17, 2005

(65) Prior Publication Data

US 2006/0011597 A1 Jan. 19, 2006

Related U.S. Application Data

(63) Continuation-in-part of application No. 10/644,345, filed on Aug. 20, 2003, now abandoned.

(51) Int. Cl.
*H05B 3/84* (2006.01)

(52) U.S. Cl.
USPC ..... 219/203; 219/202; 219/219

(58) Field of Classification Search
USPC ..... 219/202, 203, 219, 522; 338/35; 52/171.2
See application file for complete search history.

(56) References Cited

U.S. PATENT DOCUMENTS

| | | | | |
|---|---|---|---|---|
| 1,606,526 | A * | 11/1926 | Graham | 219/203 |
| 1,684,560 | A * | 9/1928 | Scott | 248/479 |
| 3,475,588 | A | 10/1969 | McMaster | |
| 3,686,473 | A | 8/1972 | Shirn et al. | |
| 3,794,809 | A | 2/1974 | Beck et al. | |
| 3,864,659 | A * | 2/1975 | Furuuchi et al. | 338/35 |
| 3,895,213 | A | 7/1975 | Levin | |
| 4,027,068 | A | 5/1977 | Saad | |
| 4,109,044 | A | 8/1978 | Marriott | |
| 4,410,843 | A | 10/1983 | Sauer et al. | |
| 4,439,013 | A | 3/1984 | Hagn et al. | |
| 4,543,466 | A | 9/1985 | Ramus | |
| 4,634,242 | A | 1/1987 | Taguchi et al. | |
| 4,750,814 | A | 6/1988 | Suzuki | |
| 4,782,216 | A | 11/1988 | Woodard | |
| 4,786,783 | A | 11/1988 | Woodard | |
| 4,820,802 | A | 4/1989 | Drent et al. | |
| 4,864,100 | A | 9/1989 | Cicak | |

(Continued)

FOREIGN PATENT DOCUMENTS

| | | | |
|---|---|---|---|
| DE | 2622272 | A1 | 11/1977 |
| EP | 0 303 586 | A2 | 2/1989 |

(Continued)

*Primary Examiner* — Brian Jennison
(74) *Attorney, Agent, or Firm* — Howard & Howard Attorneys PLLC

(57) ABSTRACT

A heatable side window assembly for an automobile, wherein the automobile includes a sideview mirror mounted generally adjacent the heatable side window assembly. The heatable side window assembly includes a glass sheet having an interior surface and an exterior surface and one or more continuous, electrical conductor strips mounted to the interior surface of the glass sheet. The conductor strip outputs radiant heat in response to an electrical current flow therethrough. The conductor strip is positioned such that it generally bounds, but does not enter, an area defined by an operator's line of sight to the sideview mirror of the vehicle. A pair of conductor pads are electrically coupled to the ends of the conductor strip. A switch is provided for selectively outputting a control signal and a controller is electrically coupled between a power supply and the pair of conductor pads. The controller provides electrical current to the conductor strip in response to the control signal so as to heat the area of the glass sheet generally adjacent to the sideview mirror.

12 Claims, 5 Drawing Sheets

(56) References Cited

U.S. PATENT DOCUMENTS

| | | | | | |
|---|---|---|---|---|---|
| 4,918,288 | A | | 4/1990 | Carter et al. | |
| 4,964,068 | A | | 10/1990 | Matsushita et al. | |
| 4,981,072 | A | | 1/1991 | Hanson et al. | |
| 5,005,020 | A | * | 4/1991 | Ogawa et al. | 343/713 |
| 5,017,933 | A | | 5/1991 | Sakurai et al. | |
| 5,119,106 | A | | 6/1992 | Murakami | |
| 5,173,586 | A | | 12/1992 | Gold | |
| 5,307,076 | A | | 4/1994 | Murakami et al. | |
| 5,319,397 | A | | 6/1994 | Ryden | |
| 5,324,374 | A | | 6/1994 | Harmand et al. | |
| 5,344,696 | A | | 9/1994 | Hastings et al. | |
| 5,420,774 | A | | 5/1995 | Wilson | |
| 5,440,425 | A | | 8/1995 | Kadooka et al. | |
| 5,466,911 | A | * | 11/1995 | Spagnoli et al. | 219/203 |
| 5,517,003 | A | | 5/1996 | Kadooka et al. | |
| 5,558,431 | A | | 9/1996 | Wilson | |
| 5,610,756 | A | | 3/1997 | Lynam et al. | |
| 5,751,071 | A | | 5/1998 | Netzer | |
| 5,808,777 | A | | 9/1998 | Lynam et al. | |
| 5,821,904 | A | | 10/1998 | Kakizawa et al. | |
| 5,925,272 | A | * | 7/1999 | Lang et al. | 219/219 |
| 6,089,971 | A | | 7/2000 | Jokela et al. | |
| 6,730,877 | B2 | * | 5/2004 | Schmidt | 219/203 |
| 2002/0153367 | A1 | * | 10/2002 | Haas et al. | 219/543 |

FOREIGN PATENT DOCUMENTS

| | | | |
|---|---|---|---|
| EP | 0 303 587 | A2 | 2/1989 |
| EP | 0 418 047 | B1 | 12/1994 |
| EP | 0 643 437 | B1 | 3/1995 |
| EP | 0 542 473 | B1 | 1/1997 |
| FR | 2806994 | | 10/2001 |
| GB | 737371 | | 9/1955 |
| JP | 07-223432 | | 8/1995 |
| JP | 08-072527 | | 3/1996 |
| JP | 08-083502 | | 3/1996 |
| JP | 08-164788 | | 6/1996 |
| JP | 08-258548 | | 10/1996 |
| JP | 08-318738 | | 12/1996 |
| JP | 09-058417 | | 3/1997 |
| JP | 09-058418 | | 3/1997 |
| JP | 09-093808 | | 4/1997 |
| JP | 09-207723 | | 8/1997 |
| JP | 09-231807 | | 9/1997 |
| JP | 09-272403 | | 10/1997 |
| JP | 10-058945 | | 3/1998 |
| JP | 10-129253 | | 5/1998 |
| JP | 10-278747 | | 10/1998 |
| JP | 11-208237 | | 8/1999 |
| JP | 11-245772 | | 9/1999 |
| WO | WO 97/37288 | | 10/1997 |
| WO | WO 98/10032 | | 3/1998 |
| WO | WO 02/098176 | | 12/2002 |

* cited by examiner

HEATED SIDE WINDOW GLASS

CROSS-REFERENCE TO RELATED APPLICATIONS

This application is a continuation-in-part of U.S. patent application Ser. No. 10/644,345 filed on Aug. 20, 2003. The disclosure of the above application is incorporated herein by reference.

FIELD OF THE INVENTION

The present invention generally relates to side window glass and, more particularly, relates to side window glass having a portion thereof electrically heated.

BACKGROUND OF THE INVENTION

The advantages of defogging and de-icing the windows of a vehicle have long been recognized for purposes of improving vehicle safety during inclement weather. However, unfortunately many systems used today to defog and de-ice windows of the vehicle, particularly side windows, require the vehicle's engine to first achieve a sufficient operating temperature. More specifically, many known systems used today to heat side windows employ a defrosting vent positioned adjacent a forward portion of the side window. This defrosting vent provides warm air blowing across the interior face of the side window to heat the side window. However, these systems are very inefficient when considering the time necessary to achieve sufficient heat. The warm air is a product of the vehicle's heating system, which only operates once the vehicle engine has achieved at least a minimum operating temperature. As many drivers know, modern automobile engines may require an extended amount of time to achieve this minimum operating temperature. Accordingly, attempts have been made to provide a means of directly heating side windows of a vehicle which results in applying immediate and direct heat to the window surface when desired.

U.S. Pat. No. 5,466,911, issued to Spagnoli et al., discloses an electrically heated window assembly by producing a concentration of heat at the portion of the front window through which a driver views an exterior mirror. This concentration of heat is produced by providing a pair of bus bars, positioned on opposing ends of the window, and a transparent conductive film positioned between the pair of bus bars. During operation, electricity flows from one bus bar to the other bus bar through the transparent conductive film, thereby producing heat within the film to heat the window.

However, the Spagnoli et al. system suffers from a number of significant disadvantages. By way of non-limiting example, the transparent conductive film is particularly susceptible to damage as it extends across the entire interior surface of the window. Such damage may include scrapes and/or gouges along the surface, peeling of the conductive film, or even failure of particular heating sections due to severing of the conductive film. Moreover, the Spagnoli et al. system may not minimize manufacturing costs as it includes a complicated, multi-part configuration requiring the application of bus bars, transparent conductive film, non-conductive breaks, temperature sensors, and the like.

U.S. Pat. No. 4,410,843, issued to Sauer et al., discloses an electrically controlled sliding window and proximity detector which includes a window heating system. The Sauer et al. system uses heat generated by current flowing through a series of horizontal, parallel conductors positioned generally in the upper half of the window. The series of conductors electrically interconnect a pair of bus bars, which extend along the forward and rearward edges of the window glass within view of the operator. During operation, current flows from a current source from one bus bar to the other bus bar through the conductors, which generate heat to heat the upper portion of the side window.

However, the Sauer et al. system suffers from a number of significant disadvantages. For example, the Sauer et al. system fails to directly heat the portion of the side window through which the operator views the exterior side view mirror. The Sauer et al. system heats the top portion of the side window, yet does not heat the portion of the side window adjacent the side view mirror. In fact, the lowest portion of the heated region of the Sauer et al. system generates the least amount of heat due to the increased length of the conductor relative to the other conductors. This increase length of the conductor produces a higher resistance in the conductor wire, thereby limiting current flow relative to the shorter conductors. Accordingly, in operation, the Sauer et al. system will first defog and/or de-ice the top of the side window and, thus, the operator must still wait for sufficient heat to build up to defog and/or de-ice the lower section of the heated region.

Accordingly, there exists a need in the relevant art to provide a side window glass having a heated region positioned generally within a line of sight of side view mirror. Furthermore, there exists a need in the relevant art to provide a heated side window glass that is simple in design and provides concentrated direct heating solely at the line of sight region of the glass. Still further, there exists a need in the relevant art to provide a heated side window glass that does not suffer from the disadvantages of the prior art.

SUMMARY OF THE INVENTION

According to the principles of the present invention, a heated side window assembly for an automobile having an advantageous construction is provided. The automobile includes a sideview mirror mounted generally adjacent the heated side window assembly. The heated side window assembly includes a glass sheet having an interior surface and an exterior surface and a single, continuous, electrical conductor strip mounted to the interior surface of the glass sheet. The conductor strip outputs radiant heat in response to an electrical current flow therethrough. The conductor strip is positioned such that it generally bounds, but does not enter, an area defined by an operator's line of sight to the sideview mirror of the vehicle. A pair of conductor pads is electrically coupled to the ends of the conductor strip. A switch is provided for selectively outputting a control signal and a controller is electrically coupled between a power supply and the pair of conductor pads. The controller provides electrical current to the conductor strip in response to the control signal so as to heat the area of the glass sheet generally adjacent to the sideview mirror.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Figure 1:
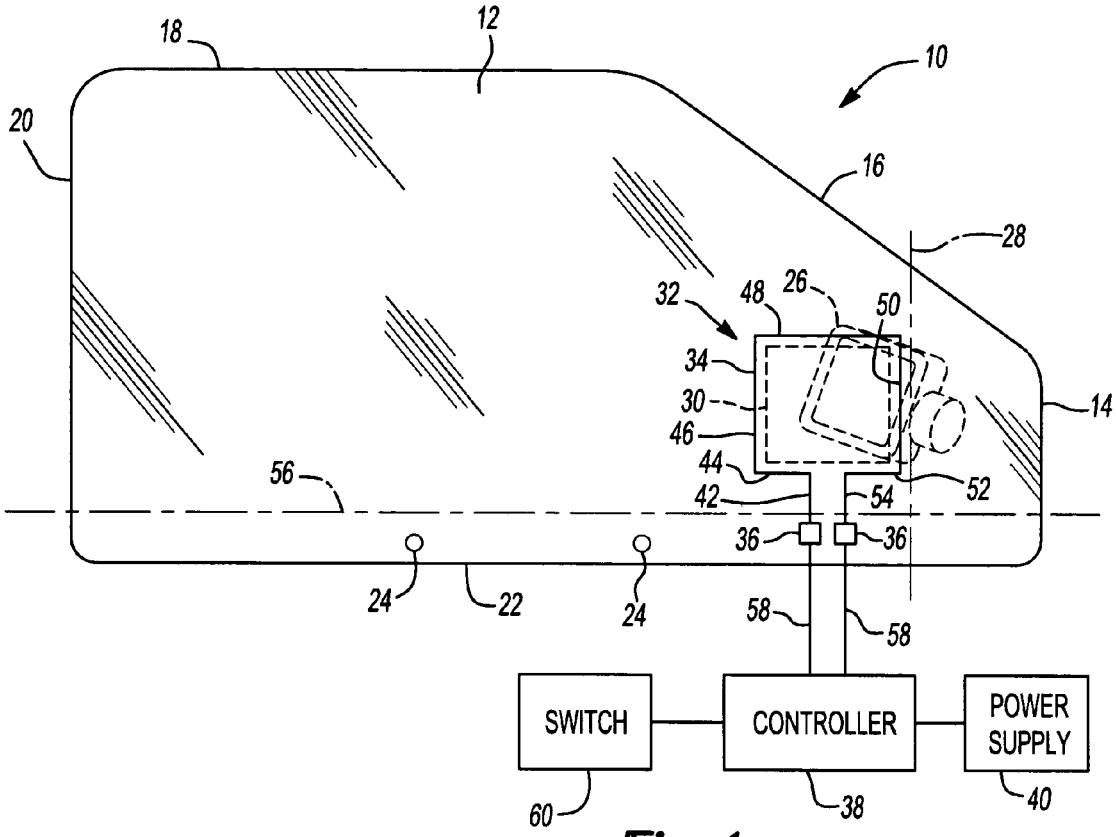
FIG. 1 is a side view of a heated side window assembly according to a first embodiment of the present invention.

Referring to the FIG. 1, a heated side window assembly 10 according to a first embodiment is illustrated having a side window (sidelite) glass 12 adapted to be slidably mounted in a front door (not shown) of a vehicle. Sidelite glass 12 may have any shape depending on the specific vehicle configuration. It should be understood that the specific sidelite glass shape described herein is merely for illustrative purposes. It should also be understood that sidelite glass 12 may be a laminated sidelite and, thus, portions of the present invention may be disposed between layers of such laminated sidelite.

Sidelite glass 12 of the present embodiment includes a front edge 14, an inclined edge 16, a top edge 18, a rear edge 20, and a bottom edge 22. Sidelite glass 12 is shaped to be slidably received within a window opening (not shown) of the vehicle door. Sidelite glass 12 further includes a pair of apertures 24 for mounting a window operating mechanism bracket (not shown) adjacent bottom edge 22 to aid in the automatic or manual raising and lowering of sidelite glass 12. As will be discussed herein, alternative sidelite glass shapes may be used, which may effect the shape of any heating system. The shape of sidelite glass 12 is also dependent upon the shape and angle of the vehicle A-pillar, which may effect the relative size and shape of front edge 14 and inclined edge 16.

A sideview mirror 26 is illustrated for use with heated side window assembly 10. Sideview mirror 26 is of conventional design and is mounted to at least one of the front doors of the vehicle. A nominal cover line 28 is shown which illustrates an edge of a shroud plate used for securely mounting sideview mirror 26 to the vehicle. During operation of the vehicle, an operator views sideview mirror 26 through a line of sight region 30 of sidelite glass 12. Line of sight region 30 of sidelite glass 12 is generally positioned adjacent sideview mirror 26 and within the line of sight between the operator and sideview mirror 26. Line of sight region 30 is preferably the area in which defogging and/or de-icing occurs during operation. Determination of the size, shape, and position of line of sight region 30 will be further discussed herein.

In the present embodiment, heated side window assembly 10 further includes a heating system 32 for heating line of sight region 30 of sidelite glass 12 without in any way obscuring line of sight region 30. Heating system 32 includes one or more conductor strips 34, a pair of conductor pads 36, a controller 38, and a power supply 40. Conductor strips 34 are preferably electrically conductive strips mounted to the interior surface of sidelite glass 12 or laminated within sidelite glass 12. In a first embodiment, conductor strips 34 are generally square-shaped such that it includes a first leg 42, a first lower strip 44, a rear strip 46, a top strip 48, a front strip 50, a second lower strip 52, and a second leg 54, which are interconnected to provide a continuous current path between first leg 42 and second leg 54. Conductor strips 34 are preferably sized so as to extend generally about the periphery of line of sight region 30 of sidelite glass 12. That is, conductor strips 34 are preferably sized to be generally outside of the direct line of sight to sideview mirror 26 for a range of vehicle operator sizes and head positions (as will be discussed herein). This arrangement thus minimizes or eliminates any visible obstructions between the operator and sideview mirror 26. Conductor strips 34 are preferably covered with electrically insulating enamel to protect the strips from corrosion and wear and tear. Conductor strips 34 may be installed on the interior surface of sidelite glass 12 via known silk-screening techniques.

In some embodiments, conductor strips 34 have varying cross-sectional area along its length that can be used to control the amount of localized electrical resistance. In areas that a higher heat output is desired, the cross-sectional area of one or more conductor strips 34 can be reduced to increase the localized resistance and, thus, increase the localized heat output. This arrangement permits a custom tailoring of the heat output within line of sight region 30 to maximize the desired heating in any one or more discrete areas within line of sight region 30.

Conductor strips 34 each terminates into one of the pair of conductor pads 36 in parallel relationship to provide electrical communication therebetween. The pair of conductor pads 36 are each made of an electrically conductive material. As can be seen in FIG. 1, the pair of conductor pads 36 are each positioned below a door or beltline 56, which schematically represents the lowermost boundary of sidelite glass 12 that is exposed to view when sidelite glass 12 is in a raised position. Accordingly, it should be appreciated that the pair of conductor pads 36 is concealed from sight for improved aesthetic quality.

Each of the pair of conductor pads 36 is electrically coupled to controller 38 via a pair of lines 58, such as flexible wires. The pair of lines 58 is sized to maintain electrical communication between controller 38 and the pair of conductor pads 36 during operation of sidelite glass 12. That is, the present invention, unlike previous known designs, permits operation of heating system 32 in every position of sidelite glass 12 because electrical communication is maintained between controller 38 and the pair of conductor pads 36. This arrangement has the benefit of permitting a vehicle operator to lower sidelite glass 12 into a position that allows for ventilation of the passenger cabin, without interfering or otherwise impeding with operation of heating system 32.

Figure 2:
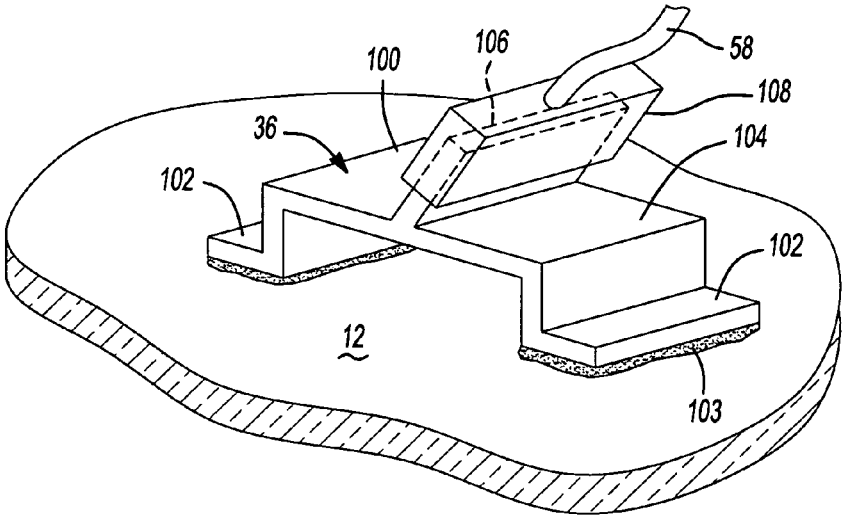
FIG. 2 is an enlarged perspective view of a connector bracket for securing electrical lines to electrically conductive strips.

As seen in FIG. 2, each conductor pad 36 may be a connector bracket 100 having a pair of downwardly extending footpads 102 bonded or otherwise fastened to sidelite glass 12 via a conventional conductive fastening material 103. Connector bracket 100 further includes a spanning portion 104 extending between the pair of downwardly extending footpads 102 and a male portion 106 extending upwardly from spanning portion 104. A female electrical connector 108 can be used to electrically and mechanically couple lines 58 to male portion 106. To ensure reliable operation, lines 58 can be fastened or otherwise held relative to sidelite glass 12 at a position that is spaced apart from conductor pads 36, such as at points 110 (FIG. 1), to relieve any physical strain or stress on conductor pads 36.

Controller 38 may be a separate controller or, more preferably, is incorporated within the main controller of the vehicle. Controller 38 is activated by the operator of the vehicle using a switch 60. Switch 60 is of conventional design and is mounted within the passenger compartment of the vehicle. Alternatively, switch 60 may be replaced or at least supplemented by an automatic switching mechanism that activates or deactivates heating system 32 in response to expiration of a predetermined time, detection of a predetermined moisture content, etc. Controller 38 is electrically coupled to power supply 40 of the vehicle. Power supply 40 may be either the battery or alternator of the vehicle. Power supply 40 is the current source for heating system 32.

Preferably, line of sight region 30 is generally positioned adjacent sideview mirror 26 and within the line of sight between the operator and sideview mirror 26. To this end, it is most preferable to determine this line of sight region 30 through three-dimensional modeling. Firstly, it should be understood that most modern vehicles are designed for a given range of occupant sizes and, thus, the general range of spine positions within the passenger compartment of the vehicle is also generally known. This spine position helps provide a range of eye positions from which to establish an eye reference range. Furthermore, the positioning of sideview mirror 26 further establishes the boundaries of the mirror. Hence, through the use of three-dimensional modeling, the various permutations may be calculated to define line of sight region 30. Ideally, conductor strips 34 are positioned about line of sight region 30, without obstructing line of sight region 30, to provide the necessary direct heating of sidelite glass 12.

Figure 5:
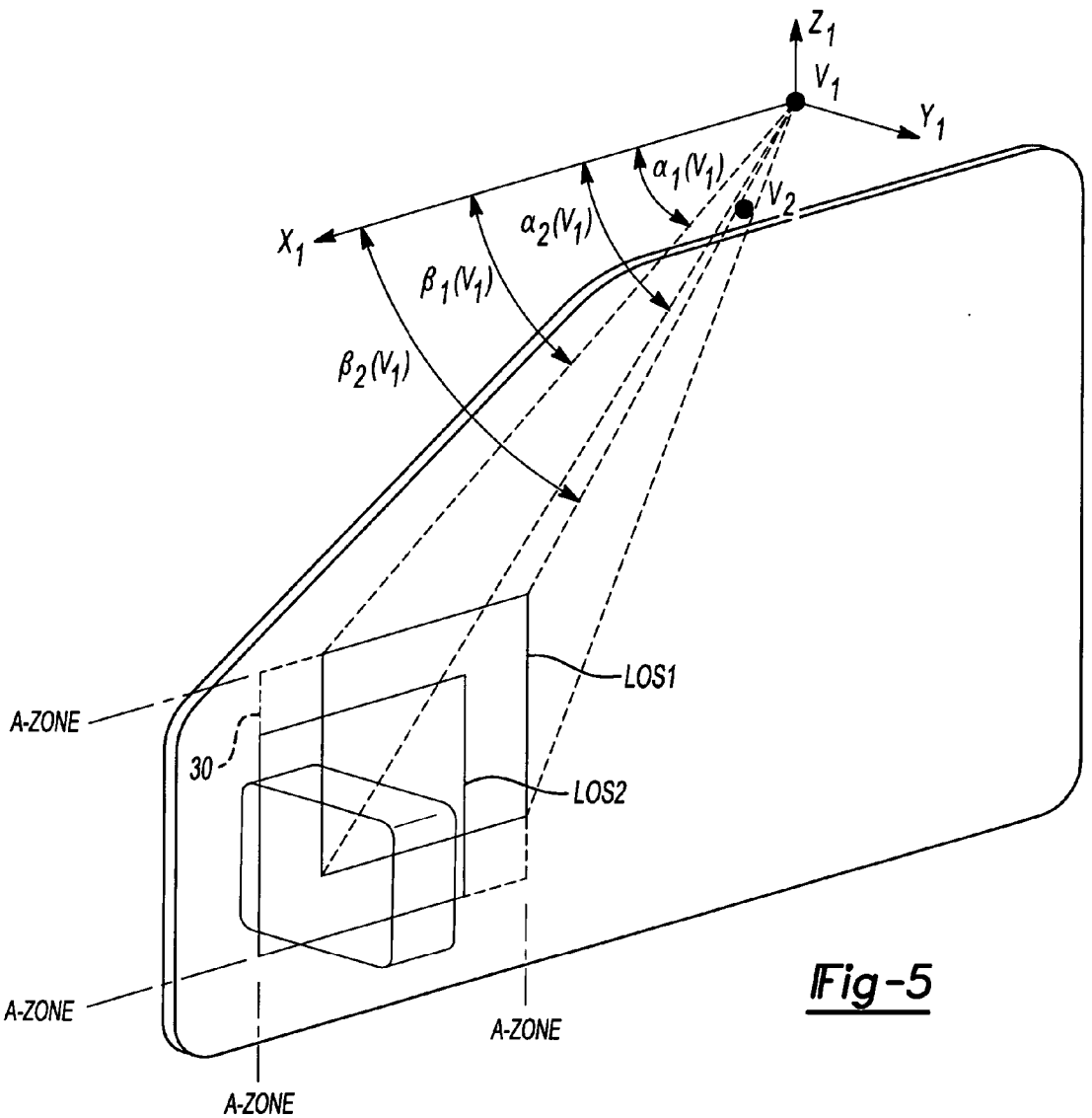
FIG. 5 is a perspective view illustrating the sight lines relative to a first visual reference point.

In other embodiments, as seen in FIG. 5, line of sight region 30 is defined based on one or more seating positions in the vehicle and one or more human body sizes and positions. To this end, human body sizes and positions are based upon, at least in part, such parameters as torso size and position and seat back (or torso) angle. These parameters may be determined by a particular manufacturer and/or developed in connection with various worldwide standards, such as but not limited to the ECE R43 standards or equivalent standards. By way of example, with reference to FIG. 5, the overall size of line of sight region 30 can be defined by a first line of sight region LOS1 and a second line of sight region LOS2. In some embodiments, line of sight region 30 can encompass the entirety of both first line of sight region LOS1 and second line of sight region LOS2. First line of sight region LOS1 can be defined through analysis of a first driver size and position. Similarly, second line of sight region LOS2 can also be defined through analysis of a second driver size and position, where the second driver has a head position different than the first driver.

In this regard, first line of sight region LOS1 is measured through the use of both horizontal and vertical planes extending at predetermined angles from a first visual reference point V1. This first visual reference point V1 can be any desired reference point or, more likely, can represent an eye point location for a first driver, such as a $95^{th}$ percentile male, in a driving position. An upper boundary of first line of sight region LOS1 is defined by a first horizontal plane passing from first visual reference point V1 downward at a predetermined angle, $\alpha$1(V1), measured in the X-Z plane. It has been found that an angle $\alpha$1(V1) in the range of about 0° to 20° below horizontal and, more particularly, 10° below horizontal can be used. A lower boundary of first line of sight region LOS1 is defined by a second horizontal plane passing from first visual reference point V1 downward at a predetermined angle, $\alpha$2(V1), measured in the X-Z plane. It has been found that an angle $\alpha$2(V1) in the range of about 11° to 31° below horizontal and, more particularly, 21° below horizontal can be used. It should be understood that angles $\alpha$1(V1) and $\alpha$2(V1) represent the angles the first driver must look up or down relative to horizontal to view the boundaries of sideview mirror 26.

A forward boundary of first line of sight region LOS1 is defined by a first vertical plane passing from first visual reference point V1 to the left (in left-seat driver positions; or to the right, in right seat driver positions) at a predetermined angle, $\beta$1(V1), measured in the X-Y plane. It has been found that an angle $\beta$1(V1) in the range of about 17° to 47° relative to straight forward sight and, more particularly, 32° relative to straight forward sight can be used. A rearward boundary of first line of sight region LOS1 is defined by a second vertical plane passing from first visual reference point V1 to the left at a predetermined angle, $\beta$2(V1), measured in the X-Y plane. It has been found that an angle $\beta$2(V1) in the range of about 30° to 60° relative to straight forward sight and, more particularly, 45° relative to straight forward sight can be used. It should be understood that angles $\beta$1(V1) and $\beta$2(V1) represent the angles the first driver must look to the left (or right as noted above) to view the boundaries of sideview mirror 26. Accordingly, the boundaries of first line of sight region LOS1 can be defined.

Figure 6:
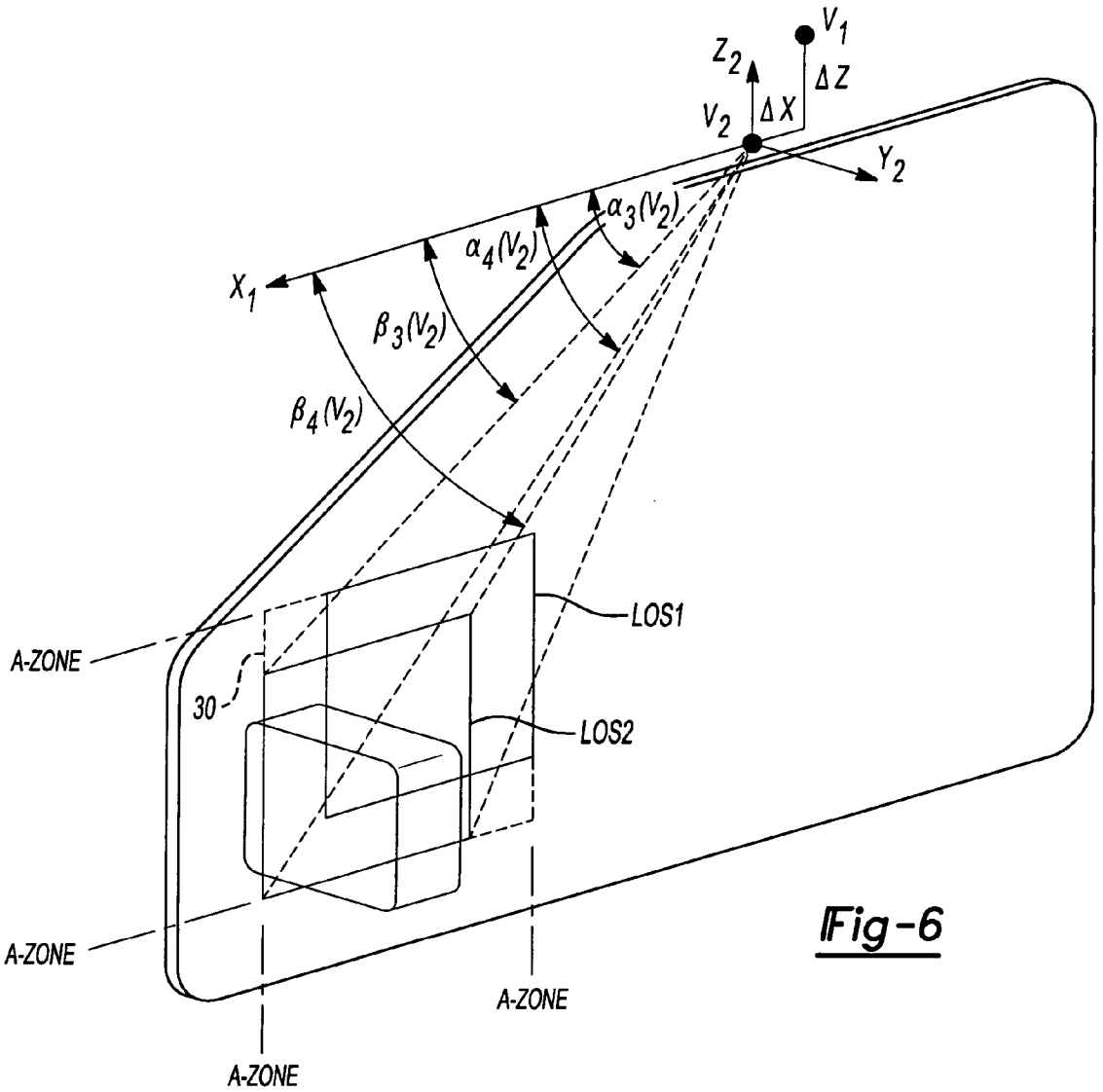
FIG. 6 is a perspective view illustrating the sight lines relative to a second visual reference point.

As seen in FIG. 6, a similar method is used to define second line of sight region LOS2 relative to a second visual reference point V2. This second visual reference point V2 can be any desired reference point or, more likely, can represent an eye point location for a second driver, such as a $5^{th}$ percentile female, in a driving position. As seen in FIG. 6, second visual reference point V2 can be, in some embodiments, slightly lower in the Z-axis, as referenced by $\Delta Z$, and slightly forward in the X-axis, as referenced by $\Delta X$, relative to first visual reference point V1. In light of most conventional vehicle seat tracks, there will be little to no lateral movement between first visual reference point V1 and second visual reference point V2 (i.e. no appreciable $\Delta Y$). As seen in FIGS. 5 and 6, due to variations in size and position of the first driver and the second driver, first line of sight region LOS1 and second line of sight region LOS2 may be shifted relative to each other.

An upper boundary of second line of sight region LOS2 is defined by a third horizontal plane passing from second visual reference point V2 downward at a predetermined angle, $\alpha$3(V2), measured in the X-Z plane. It has been found that an angle $\alpha$3(V2) in the range of about 5° above to 15° below horizontal and, more particularly, 5° below horizontal can be used. A lower boundary of second line of sight region LOS2 is defined by a fourth horizontal plane passing from second visual reference point V2 downward at a predetermined angle, $\alpha$4(V2), measured in the X-Z plane. It has been found that an angle $\alpha$4(V2) in the range of about 6° to 26° below horizontal and, more particularly, 16° below horizontal can be used. It should be understood that angles $\alpha$3(V2) and $\alpha$4(V2) represent the angles the second driver must look up or down relative to horizontal to view the boundaries of sideview mirror 26.

An forward boundary of second line of sight region LOS2 is defined by a third vertical plane passing from second visual reference point V2 to the left (in left-seat driver positions; or to the right, in right seat driver positions) at a predetermined angle, $\beta$3(V2), measured in the X-Y plane. It has been found that an angle $\beta$3(V2) in the range of about 27° to 57° relative to straight forward sight and, more particularly, 42° relative to straight forward sight can be used. A rearward boundary of second line of sight region LOS2 is defined by a fourth vertical plane passing from second visual reference point V2 to the left at a predetermined angle, $\beta$4(V2), measured in the X-Y plane. It has been found that an angle $\beta$4(V2) in the range of about 40° to 70° relative to straight forward sight and, more particularly, 55° relative to straight forward sight can be used. It should be understood that angles β3(V2) and β4(V2) represent the angles the second driver must look to the left (or right as noted above) to view the boundaries of sideview mirror 26. Accordingly, the boundaries of second line of sight region LOS2 can be defined.

To ensure that conductor pad 36 does not substantially obscure the driver's line of sight to sideview mirror 26, it is desirable that conductor pad 36 remain outside of both first line of sight region LOS1 and second line of sight region LOS2. This combined areas encompassing both first line of sight region LOS1 and second line of sight region LOS2 is bounded by A-Zone lines, as seen in FIGS. 3-6.

Figure 3:
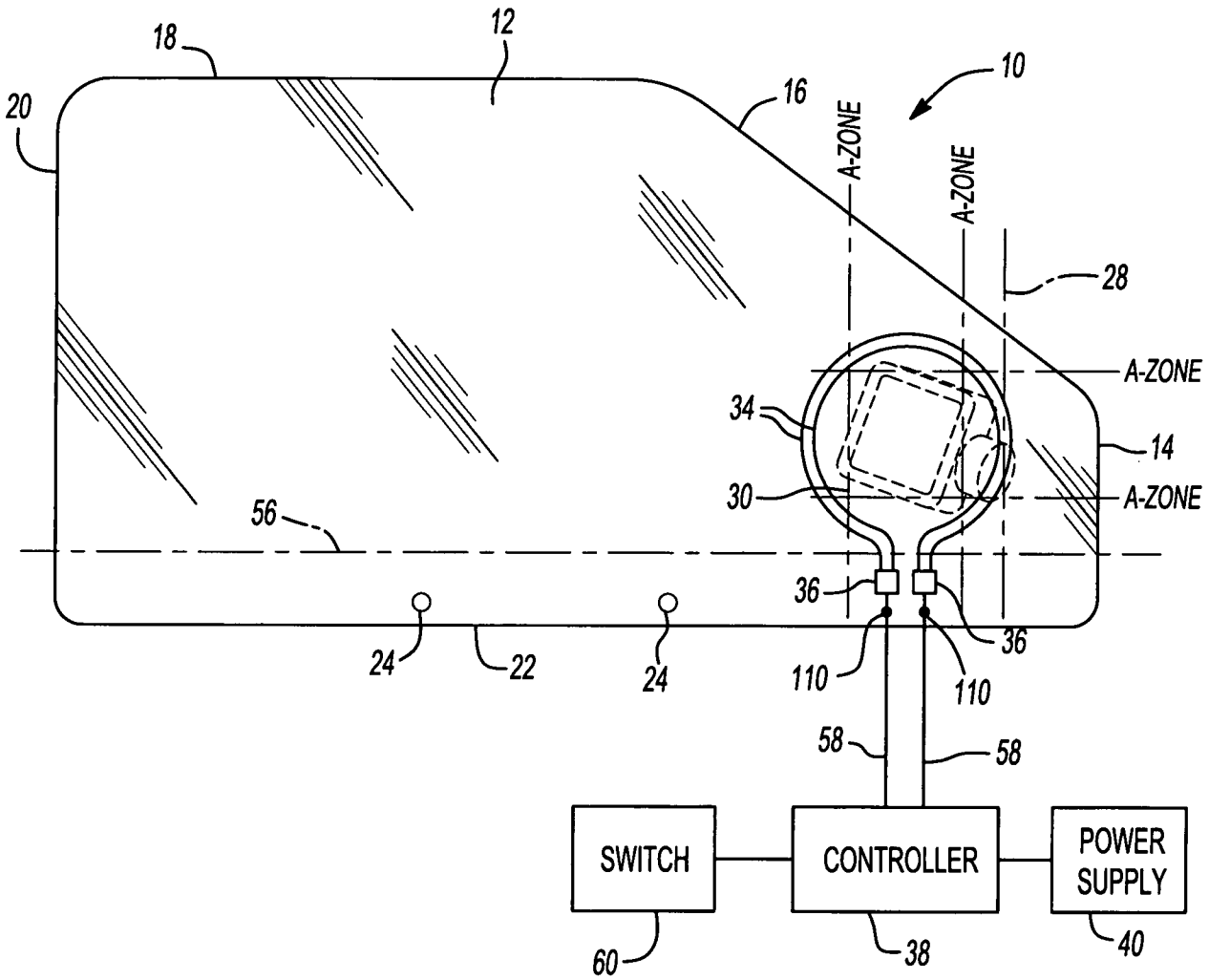
FIG. 3 is a side view of a heated side window assembly according to a second embodiment of the present invention.
Figure 4:
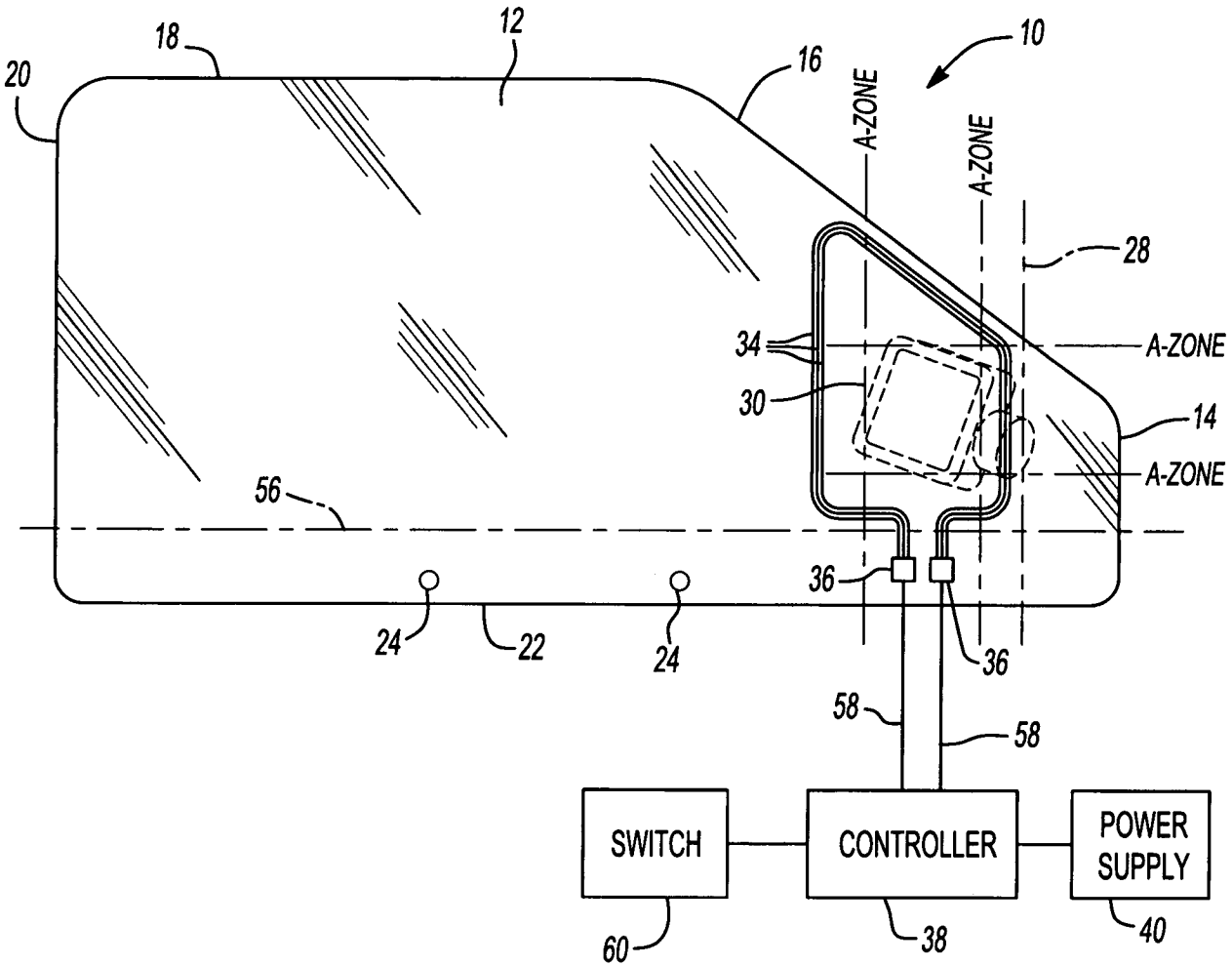
FIG. 4 is a side view of a heated side window assembly according to a third embodiment of the present invention.

With continued reference to FIGS. 3 and 4, additional embodiments of heating system 32 are provided that illustrate various configurations of conductor strips 34. For example, as seen in FIG. 3, heating system 32 may include a pair of conductor strips 34 arranged in a generally circular orientation. In this arrangement, the pair of conductor strips 34 may have a generally uniform cross-sectional area to maintain a generally consistent resistance along the length of conductor strips 34 resulting in generally consistent heating. However, this should not be regarded as the only permissible cross-sectional area configuration as other factors, such as various inherent glass properties and/or exterior cooling conditions (such as wind patterns), may warrant customizing the localized heating pattern as discussed above.

As seen in FIG. 4, heating system 32 may include three conductor strips 34 arranged in a generally trapezoidal orientation, having an inclined leg portion 112 generally parallel to inclined edge 16. As described above, the orientation of conductor strips 34 may be chosen in concert with the cross-sectional area of conductor strips 34 to result in a predetermined heating pattern within line of sight region 30 to clear the area within A-zone of moisture in the most expeditious manner.

The specific orientation and cross-sectional area of conductor strips 34 can be chosen also in concert with number of conductor strips 34 and the electrical power available to run heating system 32. As it should be appreciated, available power is finite in automobile applications because additional power would necessitate larger automotive electrical systems, which in turn would add additional load to the engine and reduce overall fuel efficiency. Therefore, the present invention enables electrical power to be efficiently used to produce rapid heat in a location where it is most needed, namely the line of sight region 30, without wasting electrical power to heat secondary areas on sidelite glass 12. In this regard, electrical power consumption can be reduced, or at least maintained, while simultaneously providing increased localized heating without obscuring the operator's vision to the sideview mirror 26.

During operation, controller 38 receives a control signal from switch 60 in response to an input by the operator, detection of moisture, etc. Controller 38 then opens an electrical circuit extending between power supply 40 and the pair of lines 58. Current then flows from power supply 40 through controller 38, a first of the pair of lines 58, a first of the pair of conductor pads 36, through one or more conductor strips 34, the other of the pair of conductor pads 36, the other of the pair of lines 58, controller 38, and back to power supply 40 to define a current path. As current flows through the current path, resistance inherent in conductor strips 34 causes heat to be generated. This heat radiates generally about each strip to heat line of sight region 30 of sidelite glass 12, to warm sidelite glass 12, thereby producing a defogging and/or deicing effect solely within the vicinity of heating line of sight region 30. It should be noted that this is accomplished without obscuring line of sight region 30.

It should be understood that due to the relative simplicity of heating system 32, it is anticipated that each of the components, including conductor strips 34 and the pair of conductor pads 36, may be made for after-market installation. That is, it is anticipated that conductor strips 34 and the pair of conductor pads 36 may be made of an electrically conductive material having an activatable adhesive applied thereto. An after-market installer could simply adhere conductor strips 34 and the pair of conductor pads 36 to a preferred location on the sidelites of the vehicle. Controller 38 and switch 60 may be mounted within the vehicle and coupled to an existing vehicle power supply. Controller 38 may then be electrically coupled to the pair of conductor pads via a pair of lines extending through the vehicle door hinge. Therefore, the present invention may find utility in retrofitting late model vehicles or those existing vehicles that are frequently exposed to fogging and/or icing conditions, such as in northern locations.

As can be appreciated from the foregoing discussion, heating system 32 of the present invention efficiently and economically provides direct, instantaneous heating of the portion of the sidelite glass that is within the operator's line of sight with sideview mirror 26.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A heated side window assembly for an automobile, said automobile having a sideview mirror mounted generally adjacent said heated side window assembly, said heated side window assembly comprising:

a glass sheet;

a single continuous, non-intersecting electrical conductor strip mounted to said glass sheet having a pair of ends, said conductor strip outputting radiant heat in response to an electrical current flow therethrough, said conductor strip being positioned such that it only bounds and heats, but does not enter, a region defined by an operator's line of sight to the sideview mirror of the vehicle, the region being less than fifty percent of the glass sheet and located on a front half of the glass sheet;

a switch selectively outputting a control signal;

a power supply; and a controller electrically coupled between said power supply and said conductor strip, said controller providing electrical current to said conductor strip in response to said control signal, wherein said operator's line of sight region encompasses a first line of sight region and a second line of sight region, said first line of sight region is defined by first and second horizontal planes passing from a first visual reference point to the sideview mirror and first and second vertical planes passing from said first visual reference point to the sideview mirror, said second line of sight region is defined by third and forth horizontal planes passing from a second visual reference point to the sideview mirror and third and forth vertical planes passing from said second visual reference point to the sideview mirror.

2. The heated side window assembly according to claim 1, further comprising:

a moisture sensor electrically coupled to said controller for activating said controller in response to detection of a predetermined about of moisture on said glass sheet so as to provide electrical current to said conductor strip.

3. The heated side window assembly according to claim 1, further comprising:

a timer electrically coupled to said controller for deactivating said controller after a predetermined amount of time so as to interrupt electrical current to said conductor strip.

4. The heated side window assembly according to claim 1 wherein said first visual reference point is defined by the visual reference point of a $95^{th}$ percentile male and said second visual reference point is defined by the visual reference point of a $5^{th}$ percentile female.

5. The heated side window assembly according to claim 1 wherein said first horizontal plane is formed at an angle between 0° and 20° relative to a horizontal axis and said second horizontal plane is formed at an angle between 11° and 31° relative to said horizontal axis.

6. The heated side window assembly according to claim 1 wherein said third horizontal plane is formed at an angle between 5° above to 15° below a horizontal axis and said forth horizontal plane is formed at an angle between 6° and 26° relative to said horizontal axis.

7. The heated side window assembly according to claim 1 wherein said first vertical plane is formed at an angle between 17° and 47° relative to a vertical axis and said second vertical plane is formed at an angle between 30° and 60° relative to said vertical axis.

8. The heated side window assembly according to claim 1 wherein said third vertical plane is formed at an angle between 27° and 57° relative to a vertical axis and said forth vertical plane is formed at an angle between 40° and 70° relative to said vertical axis.

9. The heated side window assembly according to claim 1 wherein said first horizontal plane is formed at an angle of 10° relative to a horizontal axis and said second horizontal plane is formed at an angle of 21° relative to said horizontal axis.

10. The heated side window assembly according to claim 1 wherein said third horizontal plane is formed at an angle of 5° relative to a horizontal axis and said forth horizontal plane is formed at an angle of 16° relative to said horizontal axis.

11. The heated side window assembly according to claim 1 wherein said first vertical plane is formed at an angle of 32° relative to a vertical axis and said second vertical plane is formed at an angle of 45° relative to said vertical axis.

12. The heated side window assembly according to claim 1 wherein said third vertical plane is formed at an angle of 42° relative to a vertical axis and said forth vertical plane is formed at an angle of 55° relative to said vertical axis.

* * * * *